US007686486B2

(12) United States Patent
Tessnow et al.

(10) Patent No.: US 7,686,486 B2
(45) Date of Patent: Mar. 30, 2010

(54) LED LAMP MODULE

(75) Inventors: Thomas Tessnow, Weare, NH (US); Mike Tucker, Heeniker, NH (US); Vipin Madhani, Burlington, MA (US); Peter Frey, Heidenheim (DE)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 12/011,866

(22) Filed: Jan. 30, 2008

(65) Prior Publication Data

US 2009/0003009 A1 Jan. 1, 2009

Related U.S. Application Data

(60) Provisional application No. 60/937,845, filed on Jun. 30, 2007.

(51) Int. Cl.
*F21V 21/00* (2006.01)
*F21S 8/10* (2006.01)
*F21V 5/00* (2006.01)

(52) U.S. Cl. ..... 362/487; 362/545; 362/547; 362/332

(58) Field of Classification Search ..... 362/640, 362/658, 487, 520, 521, 545, 547, 546, 549, 362/332, 294, 373, 800
See application file for complete search history.

(56) References Cited

U.S. PATENT DOCUMENTS

| | | | | |
|---|---|---|---|---|
| 1,955,599 A | | 4/1934 | Lamblin-Parent | |
| 2,556,328 A | * | 6/1951 | Hinds | 362/309 |
| 3,708,221 A | | 1/1973 | Schaefer | |
| 3,743,385 A | | 7/1973 | Schaefer | |
| 4,207,607 A | * | 6/1980 | Gulliksen | 362/282 |
| 4,796,171 A | * | 1/1989 | Lindae et al. | 362/308 |
| 6,069,447 A | * | 5/2000 | Vilanilam et al. | 315/56 |
| 6,435,691 B1 | * | 8/2002 | Macey et al. | 362/101 |
| 6,685,339 B2 | * | 2/2004 | Daughtry et al. | 362/249.05 |
| 6,866,401 B2 | * | 3/2005 | Sommers et al. | 362/268 |
| 6,986,593 B2 | | 1/2006 | Rhoads et al. | |

(Continued)

FOREIGN PATENT DOCUMENTS

DE 202006 015980 12/2006

(Continued)

OTHER PUBLICATIONS

European Search Report and Annex in corresponding European Patent Application No. 08 01 1563 mailed Mar. 2, 2009.

*Primary Examiner*—Jacob Y Choi
(74) *Attorney, Agent, or Firm*—Edward S. Podszus

(57) ABSTRACT

An LED lamp (10) has a housing (12) with an interior wall (14) defining a cavity (16). An LED light source (26) is positioned in the cavity (16) and project light in a forward direction. A reflector (28) having a reflective surface (30), a forward opening (32) and a rear opening (34) surrounds the light source (26) and a complex lens (38) closes the forward opening. The lens (38) comprises a first optical refractive element (40) arranged around a peripheral edge (42) and a second optical refractive element (44) centrally located on the lens (38); the first optical refractive element (40) including a plurality of flute lenses (40*a*) and the second optical refractive element (44) comprising a concavo-convex lens (44*a*).

3 Claims, 3 Drawing Sheets

U.S. PATENT DOCUMENTS

| | | | | |
|---|---|---|---|---|
| 7,210,834 | B2 | 5/2007 | Sazuka et | |
| 7,255,460 | B2 | 8/2007 | Lee | |
| 2005/0018445 | A1 | 1/2005 | Sazuka et al. | |
| 2006/0215408 | A1 | 9/2006 | Lee | |
| 2007/0189019 | A1* | 8/2007 | Klipstein | 362/347 |

FOREIGN PATENT DOCUMENTS

| | | |
|---|---|---|
| DE | 20 2006 015 980 U1 | 1/2007 |
| EP | 1 136 749 | 9/2001 |
| EP | 1 705 421 | 9/2006 |
| FR | 2 858 043 | 1/2008 |

* cited by examiner

LED LAMP MODULE

CROSS-REFERENCE TO RELATED APPLICATION

This application claims priority from Provisional Patent Application Ser. No. 60/937,845, filed Jun. 30, 2007.

TECHNICAL FIELD

This application relates to light sources and more particularly to light emitting diode (LED) light sources. Still more particularly it relates to automotive light sources that are modularized, such, for example as may particularly be adapted for use in foggy conditions.

BACKGROUND ART

Lights have been provided motor vehicles virtually since their inception. Such lights have employed incandescent light bulbs as the light source and these light sources have been subjected to occasional failure at inopportune times. Further, it has been difficult to provide the proper light distribution to achieve the desired purpose. Additionally, the optics employed by some of these prior art lights, in particular, fog lights, were either reflectors or projectors. Projectors use a reflector to collect the light and image it into the focal point of a projector lens. LEDs have been used in forward lighting applications either as an array of individual LED sources or as a multi-chip source with a solid optic (either glass or plastic) and a projector lens. These prior art devices have been large and expensive.

DISCLOSURE OF INVENTION

It is, therefore, an object of the invention to obviate the disadvantages of the prior art.

It is another object of the invention to enhance fog lights.

Yet another object of the invention is the improvement of operation of lights and the improvement of life expectancy.

A still further object of the invention is the provision of a lamp for vehicle applications that comprises a small package employing a small diameter optic. The package preferably comprises a completely sealed self-contained unit with a wide beam spread and high optical efficiency.

These objects are accomplished, in one aspect of the invention, by the provision of an LED lamp comprising: a housing with an interior wall defining a cavity providing an opening facing a forward direction, the cavity having a back wall, the housing including a heat sink extending on an exterior side of the back wall; a circuit board mounted in the cavity adjacent the back wall in thermal communication therewith. An LED light source is mounted on the back wall and is surrounded by the circuit board. The LEDs project light in the forward direction and sideways directions up to 90 degrees from the forward direction; a reflector including a paraboloidal reflective surface and having a forward opening and a rear opening therein, the reflector being positioned in the cavity, the LED light source positioned in the rear opening to face the reflective surface, the reflector directing intercepted light from the LED; a lens coupling with the housing to enclose the circuit board, LED light source and reflector, the lens having a first optical refractive element arranged around a peripheral edge and having a second optical refractive element centrally located on the cover lens. If desired, a protective cover may span the lens, the protective cover being fixed to the housing; a gasket can be positioned intermediate the protective lens and the housing, when the protective lens is employed, sealing the cavity; and a plug coupling formed on the exterior of the housing for the receipt of an electrical supply lead to couple electric power to the circuit board.

This unit achieves the long life expectancy provided by light emitting diodes and the plural-function lens directs the light from the LEDs and the paraboloidal reflector in the proper manner.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
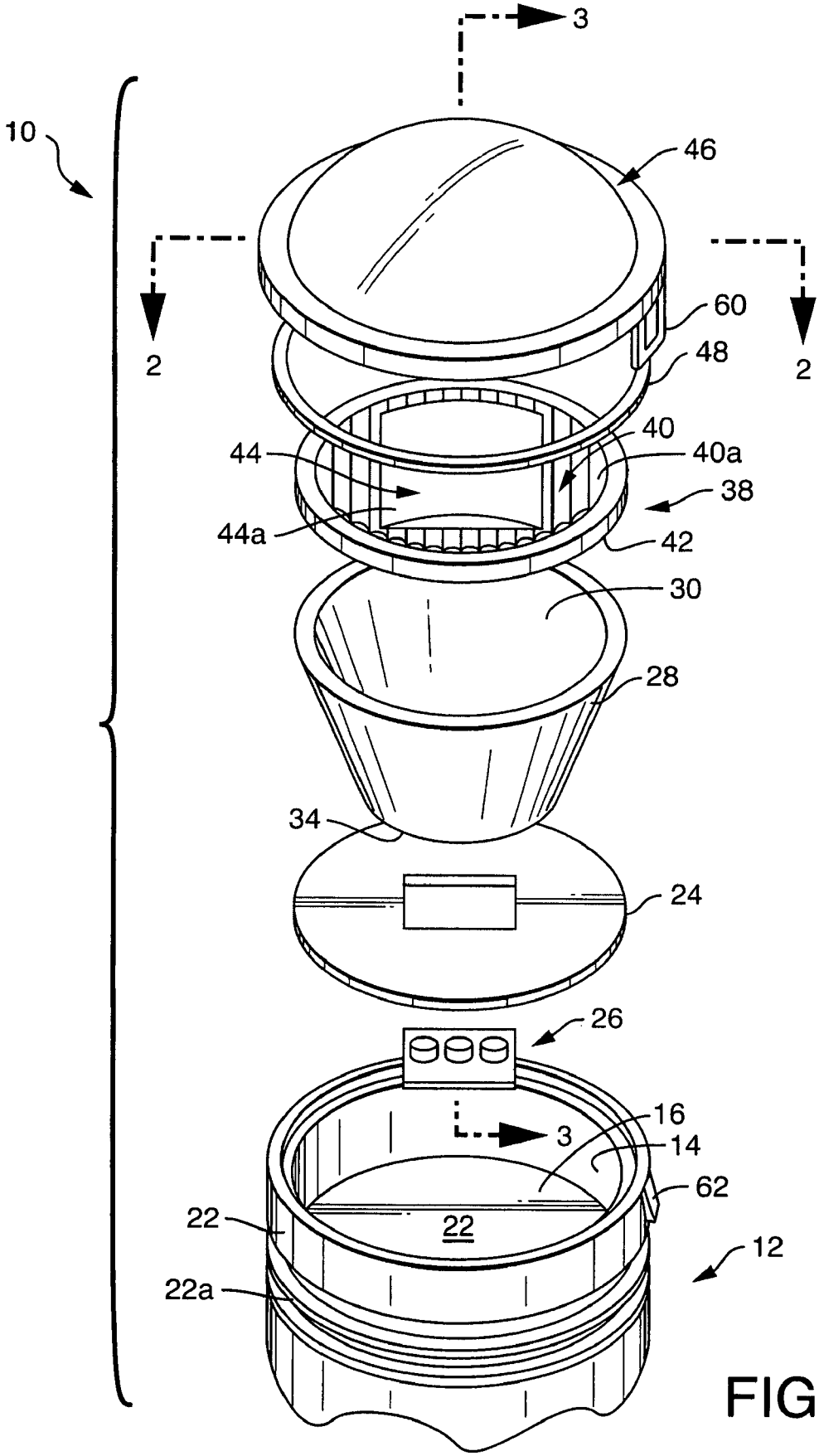
FIG. 1 is an exploded, perspective view of an embodiment of the invention.

Referring now to the drawings with greater particularity, there is shown in FIG. 1 an LED lamp 10, that can be, for example, a fog lamp, comprising a housing 12 with an interior wall 14 defining a cavity 16 providing an opening facing a forward direction "F", the cavity 16 having a back wall 18. The housing 12, which preferably is made from a suitable metal, such as aluminum, includes a heat sink 20 extending on an exterior side 22 of the back wall 18.

Figure 2:
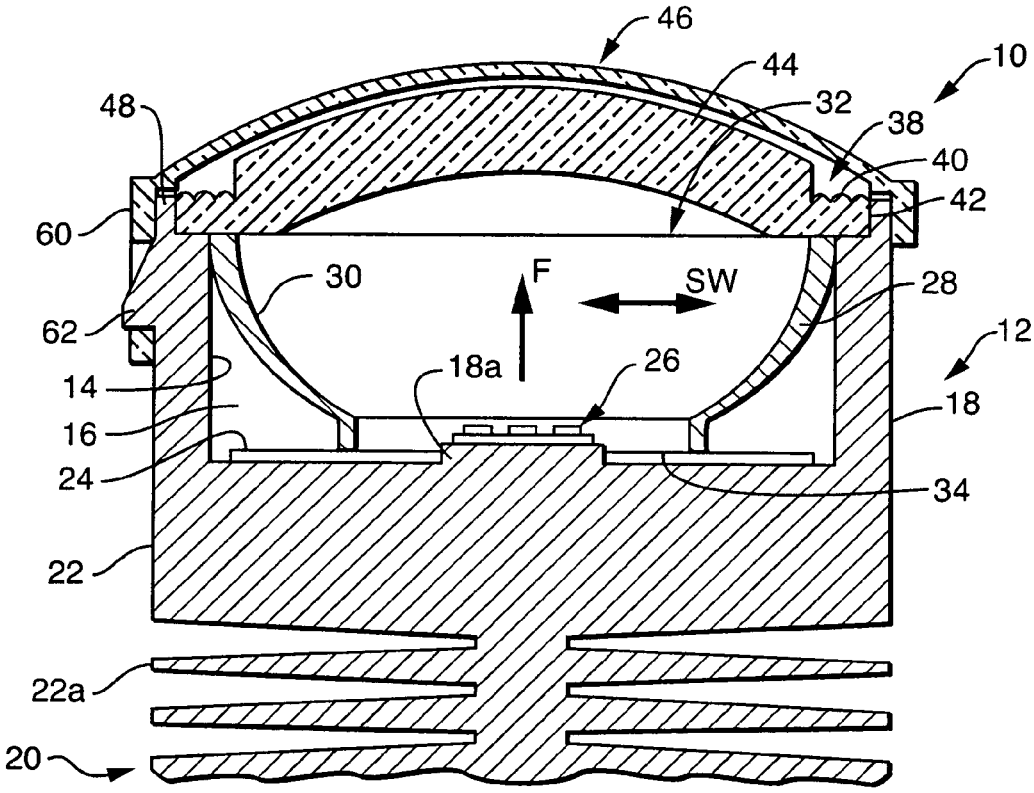
FIG. 2 is a partial, sectional view, in elevation, taken along the line 2-2 of FIG. 1.
Figure 3:
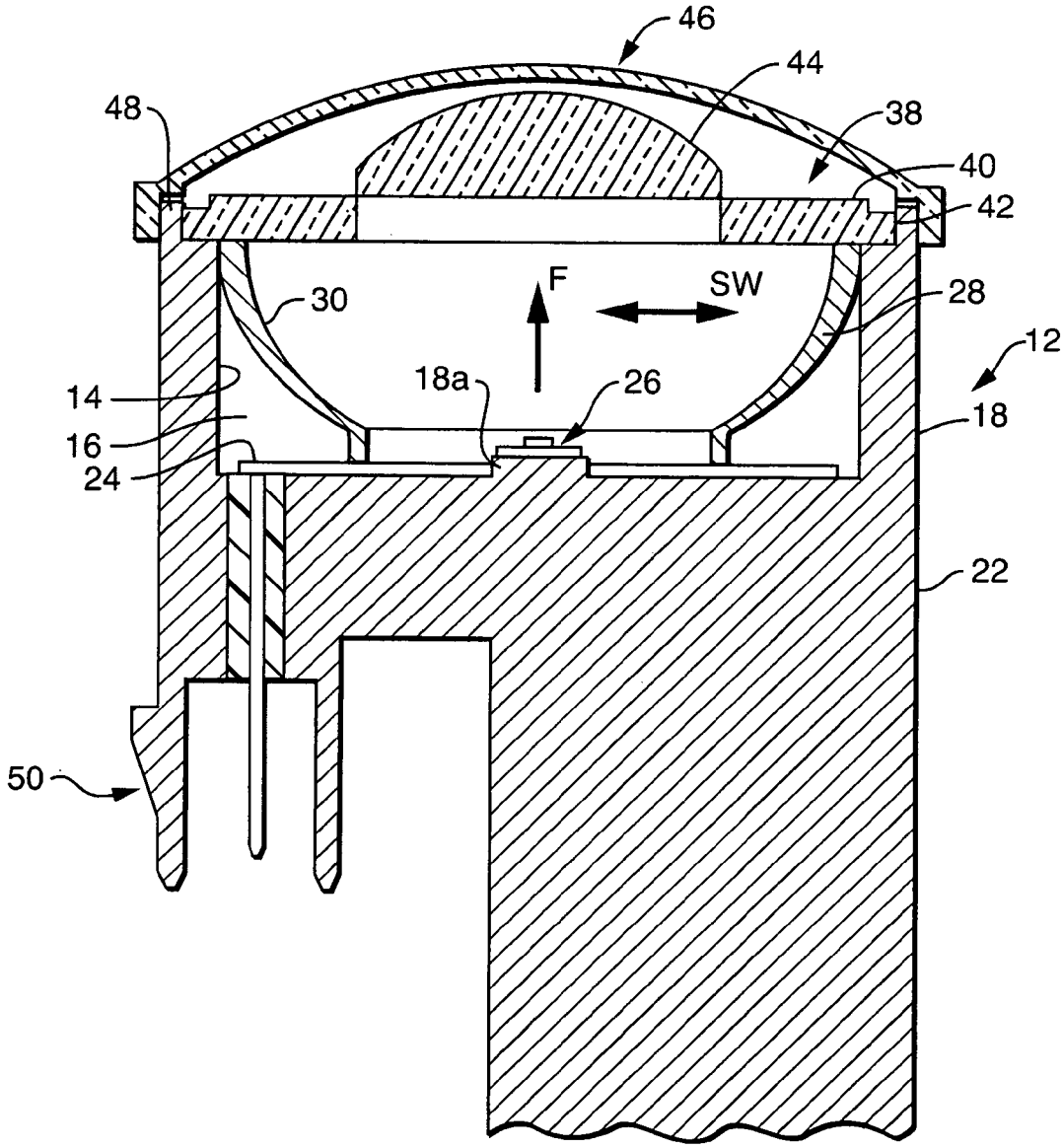
FIG. 3 is a partial, sectional view, in elevation, taken along the line 3-3 of FIG. 1.

An LED light source 26 is fixed to the back wall 18, preferably upon a boss 18*a* (shown best in FIGS. 2 and 3) and projects light in the forward direction "F" and sideways directions "SW" up to 90 degrees from the forward direction "F". While three LEDs are shown in FIGS. 1 and 2 in the interest of clarity, in a preferred embodiment of the invention, 5 LEDs would be employed, with a system optical efficiency of about 70%. A beam pattern with a large spread, e.g., >35 degrees left and right and a high peak intensity in the center (about 3000 cd) is ideal for this light source. This can be achieved with 5 chips providing 360 lm or more and about 15 W. The maximum junction temperature should be no more than 150° C.

A circuit board 24 is mounted in the cavity 16 adjacent the back wall 18 in thermal communication therewith and includes a cutout 24*a* for receiving the LED light source 26.

A reflector 28 includes a paraboloidal reflective surface 30 and has a forward opening 32 and a rear opening 34 therein. The reflector 28 is positioned in the cavity 16 with the LED light source 26 positioned in the rear opening 34 to face the reflective surface 30. The reflector 28 directs intercepted light from the LED light source 26.

In order to collect enough light a solid collimating optic would have to be very close to the light source 26. The only transparent material which can survive automotive conditions at 150° C. is glass and this material has design limits that make some optical solutions impossible. It is also expensive.

To obviate these disadvantages there is provide a complex projector lens 38 formed of plastic. The lens 38 couples to the housing 12 to enclose the circuit board 24, the LED light source 26 and the reflector 28. The lens 38 is far enough removed from the light source 26 to allow the use of plastic material and has a first optical refractive element 40 in the form of a plurality of fluted lenses 40*a* arranged around a peripheral edge 42 and has a second optical refractive element 44 in the form of a concavo-convex lens 44*a* centrally located thereon. This portion of the lens images the LED light source 26 directly. That is, it focuses the light vertically to get high intensity but spreads it horizontally. This requires the concavo-convex configuration since a standard projection lens could not achieve the large spread angles without being only a few millimeters away from the light source, which would cause thermal problems. Due to the large focal length and desired small diameter, up to half of the light generated would miss the lens. To recover this light, the reflector is provided which captures and collimates that light and passes it through the outer or peripheral part of the lens that contains the vertical flutes 40*a*. These flutes 40*a* spread the light horizontally.

An optional protective cover 46 spans the lens 38 and is fixed to the housing 12, for example, by female connectors 60 that project from the cover 46 and engage male portions 62 on the housing 12.

A gasket 48 is positioned intermediate the cover 46 and the housing 12 and seals the cavity 16.

A plug coupling 50 is formed on the exterior 22 of the housing 12 for receipt of an electrical supply lead to couple electric power from the vehicle supply to the circuit board 24 and thence to the LED light source.

In operation the first optical refractive element 40 that is arranged around the peripheral edge 42 of the lens 38 intercepts light emitted by the LED light source 26 and the light reflected in the forward direction from the reflector 28. The first optical refractive element directs the intercepted light into a first horizontal band centered on or below the horizontal. The second optical element 44 is centrally located on lens 38 and intercepts light emitted directly forward from the LED light source 26 and directs that intercepted light to a second horizontal band overlapping the first horizontal band.

Thus there is provided a small, self-contained fog lamp that achieves good light balance via a complex lens with a center portion for projection and an outer portion for spreading collimated light from a reflector via the vertical flutes. The lens can be formed from glass or plastic material; however, plastic is preferred. The construction lends itself to other applications, for example, as the low or high beam for a headlight; a backup lamp; or general lighting applications, by modifying the optical presentation to form a specific beam pattern.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An LED lamp comprising:

a housing with an interior wall defining a cavity providing an opening facing a forward direction, said cavity having a back wall, said housing including a heat sink extending on an exterior side of said back wall;

a circuit board mounted in said cavity adjacent said back wall in thermal communication therewith;

an LED light source mounted on said back wall and surrounded by said circuit board and projecting light in said forward direction and sideways directions up to 90 degrees from said forward direction;

a reflector including a paraboloidal reflective surface and having a forward opening and a rear opening therein, said reflector being positioned in said cavity, said LED light source positioned in said rear opening to face said reflective surface, said reflector directing intercepted light from said LED;

a lens coupling with said housing to enclose said circuit board, LED light source and reflector, said lens having a first optical refractive element arranged around a peripheral edge and having a second optical refractive element centrally located on said lens;

said first optical refractive element including a plurality of flute lenses and said second optical refractive element comprising a concavo-convex lens; and a plug coupling formed on said exterior of said housing for receipt of an electrical supply lead to couple electric power to said circuit board.

2. The LED lamp of claim 1 wherein a protective cover spans said lens, said protective cover being fixed to said housing.

3. An LED fog lamp comprising:

a housing with an interior wall defining a cavity providing an opening facing a forward direction (F), said cavity having a back wall, said housing including a heat sink extending on an exterior side of said back wall, said heat sink including at least one radially extending thin wall exposed to air;

a circuit board mounted in said cavity adjacent said back wall in thermal communication therewith;

an LED light source supported on said back wall and surrounded by said circuit board and projecting light in said forward direction (F) and sideways directions (SW):

a reflector having a reflective surface, and a forward opening and a rear opening, said reflector being positioned in said cavity and pressing said circuit board toward said back wall to enable good thermal conduction from said circuit board to said back wall, said LED light source being positioned in said reflector rear opening to face said reflective surface; said reflector directing intercepted light from said LED light source in said forward direction;

a lens coupling with said housing to enclose said circuit board, LED light source and said reflector, said lens having a first optical refractive element arranged around a peripheral edge of said lens and having a second optical refractive element centrally located on said lens;

said first optical refractive element including a plurality of flute lenses and said second optical refractive element comprising a concavo-convex lens;

a protective cover spanning said housing and sealing said cavity; and a plug coupling formed on said exterior of said housing for receipt of an electrical supply lead to couple electric power to said circuit board.

* * * * *